US008844588B2

(12) United States Patent
Low et al.

(10) Patent No.: US 8,844,588 B2
(45) Date of Patent: Sep. 30, 2014

(54) MULTI-FUNCTIONAL GOLF PUTTER HEAD COVER

(76) Inventors: Jeffrey M. Low, Midvale, UT (US); James Richard Wilkinson, Bend, OR (US)

( * ) Notice: Subject to any disclaimer, the term of this patent is extended or adjusted under 35 U.S.C. 154(b) by 862 days.

(21) Appl. No.: 12/873,014

(22) Filed: Aug. 31, 2010

(65) Prior Publication Data

US 2011/0048596 A1 Mar. 3, 2011

Related U.S. Application Data

(60) Provisional application No. 61/238,314, filed on Aug. 31, 2009.

(51) Int. Cl.
*A63B 57/00* (2006.01)
*A63B 55/00* (2006.01)

(52) U.S. Cl.
CPC ..... *A63B 55/007* (2013.01); *A63B 57/0087* (2013.01); *A63B 2209/08* (2013.01); *A63B 2209/10* (2013.01); *A63B 57/0075* (2013.01); *A63B 57/0068* (2013.01); *A63B 57/0031* (2013.01)
USPC ..... 150/160; 150/154; 150/155; 150/156; 150/157; 150/158; 150/159; 150/161; 150/168; 15/113; 15/118; 15/160; 15/209.1; 15/210.1; 473/206; 473/256; 473/282; 473/372; D21/754; D21/789

(58) Field of Classification Search
USPC ..... 150/154, 160; 206/315.3, 315.4, 315.5, 206/315.6, 362; 15/113–118, 160, 209.1, 15/210.1; 473/206, 256, 282, 372; D21/754, 789
See application file for complete search history.

(56) References Cited

U.S. PATENT DOCUMENTS

| | | | | | |
|---|---|---|---|---|---|
| 2,752,973 | A | * | 7/1956 | Stamp | 206/315.6 |
| 3,128,812 | A | * | 4/1964 | Scheurer | 206/315.4 |
| 3,938,570 | A | | 2/1976 | Stewart | |
| 4,625,862 | A | * | 12/1986 | Clayton | 206/315.3 |
| 4,667,716 | A | * | 5/1987 | Solheim et al. | 150/160 |
| 4,971,126 | A | * | 11/1990 | Borenstein | 150/160 |
| 5,050,655 | A | * | 9/1991 | Borenstein | 150/160 |
| 5,075,918 | A | * | 12/1991 | Zeltner et al. | 15/210.1 |
| 5,215,136 | A | | 6/1993 | Flanders et al. | |
| 5,311,987 | A | * | 5/1994 | Shin | 206/315.6 |
| 6,484,771 | B2 | * | 11/2002 | Kloos et al. | 206/315.4 |
| 6,546,981 | B2 | | 4/2003 | Cameron | |
| 6,612,412 | B2 | * | 9/2003 | Sanderson et al. | 190/18 A |
| D485,879 | S | * | 1/2004 | Cameron et al. | D21/754 |

(Continued)

FOREIGN PATENT DOCUMENTS

| | | | |
|---|---|---|---|
| CA | 2393163 | A | 1/2004 |
| KR | 200220079383 | A | 10/2002 |

*Primary Examiner* — Fenn Mathew
*Assistant Examiner* — Cynthia Collado
(74) *Attorney, Agent, or Firm* — Matthew J. Lattig; Charter IP, LLC

(57) ABSTRACT

A head cover for a golf club includes a first surface having a removable cleaning pad thereon, and a second surface on which at least one golf accessory constructed of a ferrous metal is removably attached thereto. The second surface is part of a tri-layer construction with magnets forming the second middle layer so as to so retain the golf accessory thereon. The cleaning pad is removed by the golfer from the first surface and includes a scrubbing area to remove grit and/or debris from one of a golf ball and a golf club face.

16 Claims, 15 Drawing Sheets

(56) References Cited

U.S. PATENT DOCUMENTS 7,361,097 B2 4/2008 Hot
7,458,405 B1 12/2008 Gaffney
7,954,526 B2 * 6/2011 Chen ..... 150/160
2003/0223651 A1 * 12/2003 Weleczki ..... 383/4
2005/0069672 A1 * 3/2005 Katsin ..... 428/88
2008/0264514 A1 * 10/2008 Tessier et al. ..... 141/4
2008/0264814 A1 * 10/2008 Campbell ..... 206/315.5
2009/0188593 A1 7/2009 Cameron

* cited by examiner

MULTI-FUNCTIONAL GOLF PUTTER HEAD COVER

PRIORITY STATEMENT

The present application claims the benefit under 35 U.S.C. §119(e) of U.S. provisional patent application Ser. No. 61/238,318 to Jeffrey M. Low, filed Aug. 31, 2009, the entire contents of which is hereby incorporated by reference herein.

BACKGROUND

1. Field

Example embodiments in general relate to a multi-functional golf putter head cover configured to carry golf accessories and clean a golf ball and golf club.

2. Related Art

Over the years golfers and others have developed a number of accessory products for use with golf clubs and golf bags. Some conventional golf accessories relate to some form of a golf club cover, which includes a combination golf club cover which integrally incorporates a brush means and/or scraper means for easy use in cleaning the golf clubs while a golfer is on the fairway of a course. Other accessories are directed to a club or putter cover which incorporates a Velcro patch for holding a removable towel to clean a ball/club face and a holder mechanism for a pitch repair tool or ball marker. A further club cover accessory incorporates magnetic material to affix the cover securely to the club itself.

Another conventional putter cover accessory comprises a knitted fabric cylinder that is folded, rolled, reversed, and sewn so as to contain two compartments, one of which is waterproof so as to be used to clean golf balls. The waterproof compartment is lined with a non-absorbent yarn to facilitate the washing of golf balls. The other compartment is lined with an absorbent yarn that stretches to conform to the shape of an inserted putter head.

A further conventional golf club head cover with storage includes a cover body, a closure flap and a pocket. The cover body defines an interior cavity that receives the putter head. The head cover includes a ball marker holder on an outer surface thereof, the holder having a holder body sized and shaped so that a ball marker is receivable therein. A holder magnet is integrated into the holder body; the ball marker being constructed of a ferrous metal that is attracted to the magnet so that the ball marker is retained within the holder body by magnetic attraction when no other forces are placed on the marker.

However, none of the above conventional golf club cover accessories combine the ability to remove a fixedly securable cleaning pad from the cover itself, so as to remotely clean a club head or ball, with a magnetic holding surface formed therein to secure additional golf accessories such as ball markers and divot repair tools thereon.

SUMMARY

An example embodiment is directed to a head cover for a golf club. The head cover includes a first surface having a removable cleaning pad thereon, and a second surface on which at least one golf accessory constructed of a ferrous metal is removably attached thereon.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments.

DETAILED DESCRIPTION

Figure 1:
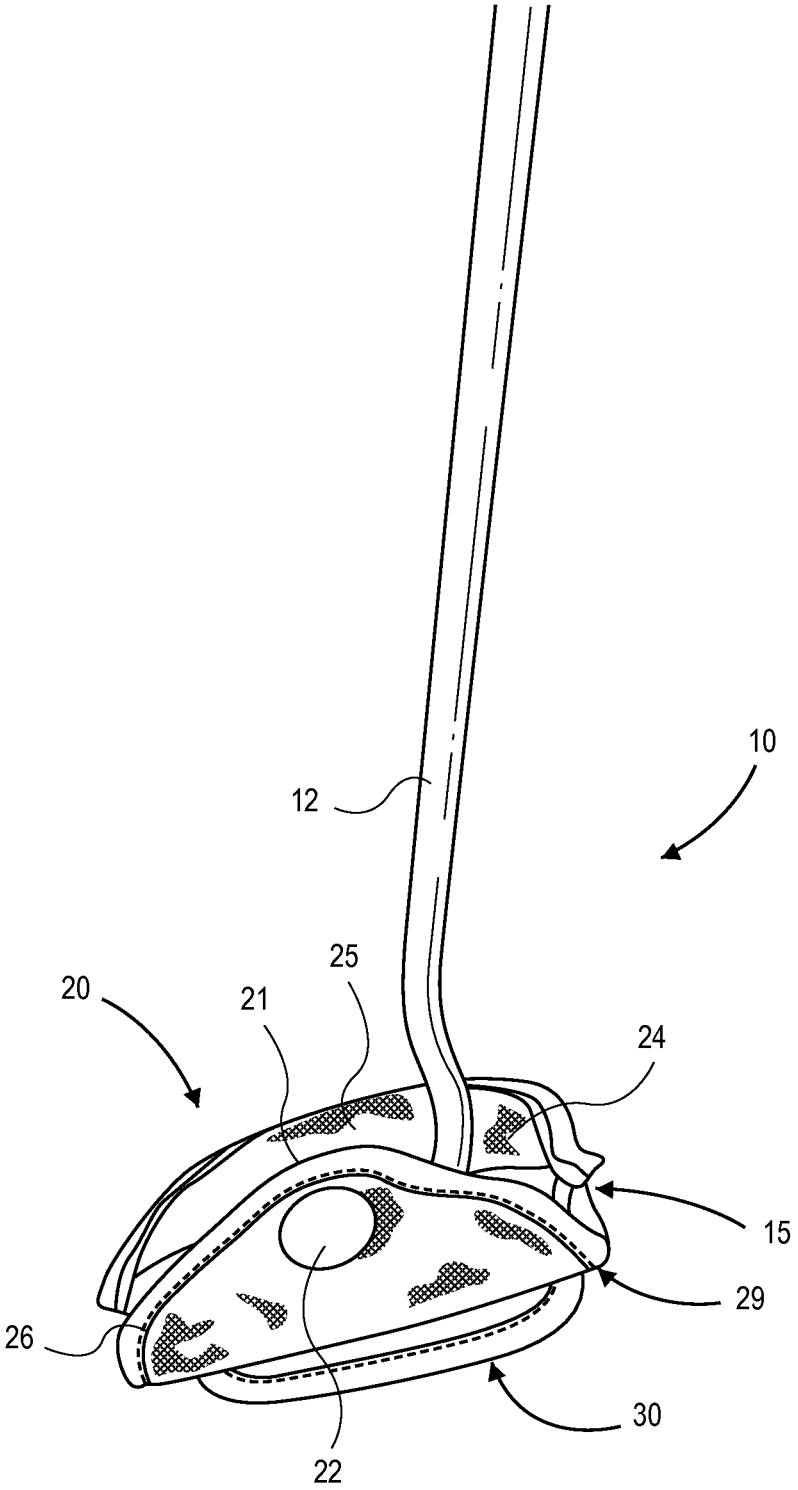
FIG. 1 is a front perspective view of a golf putter head cover installed on a standard sized mallet-style putter, in accordance with an example embodiment.
Figure 2:
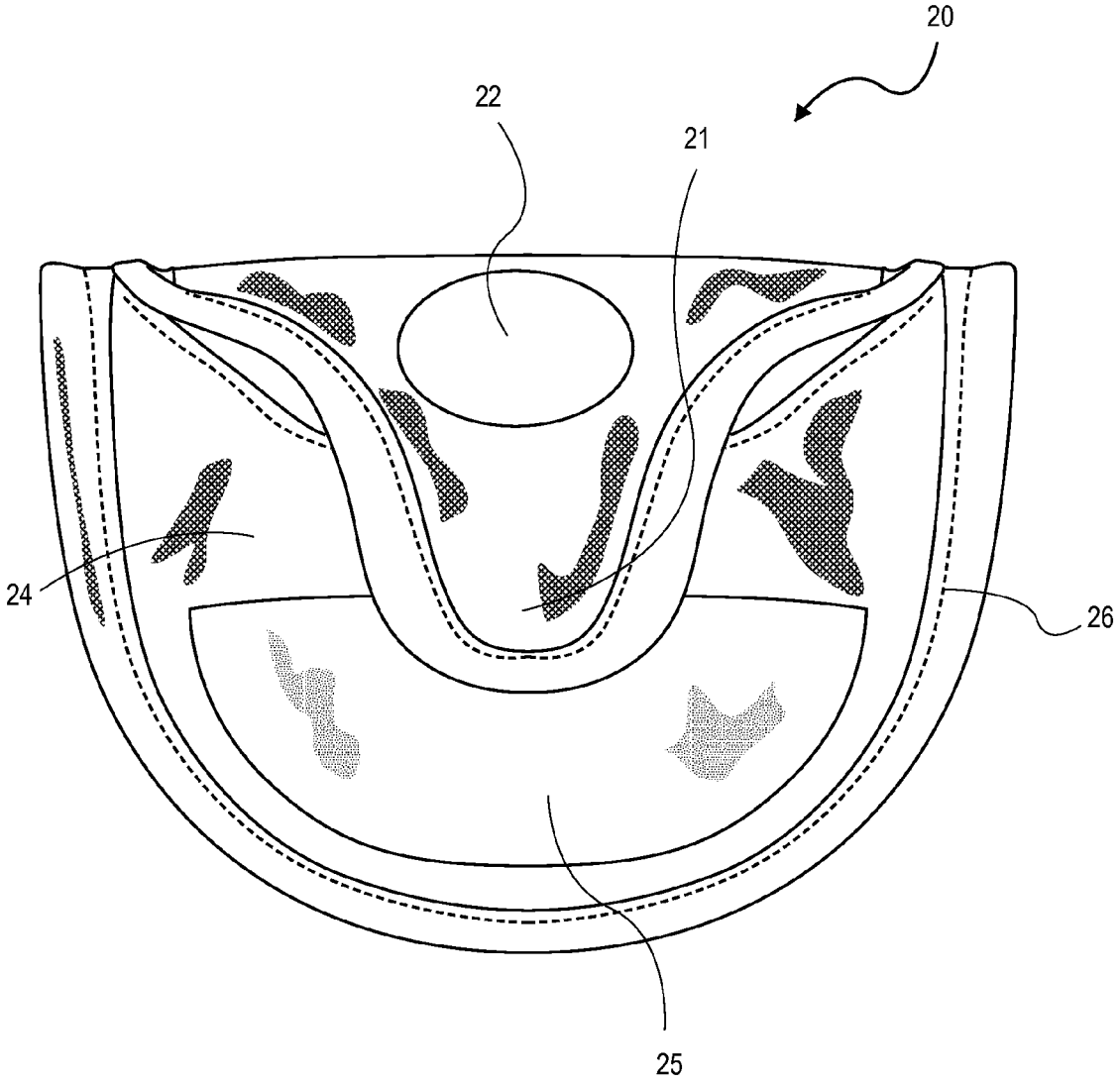
FIG. 2 is a top plan view of the head cover of FIG. 1.
Figure 3:
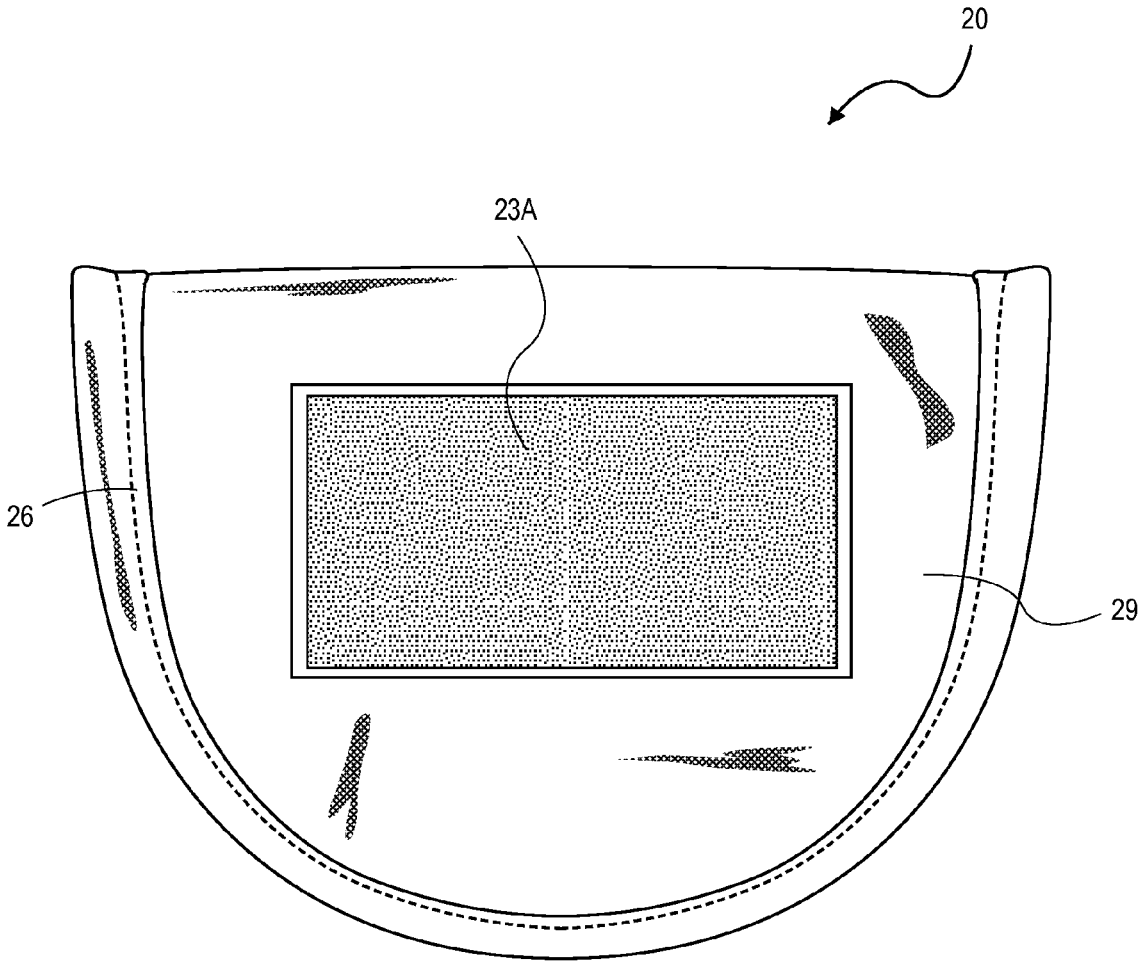
FIG. 3 is a bottom plan view of the head cover of FIG. 1 with the cleaning pad removed.
Figure 4:
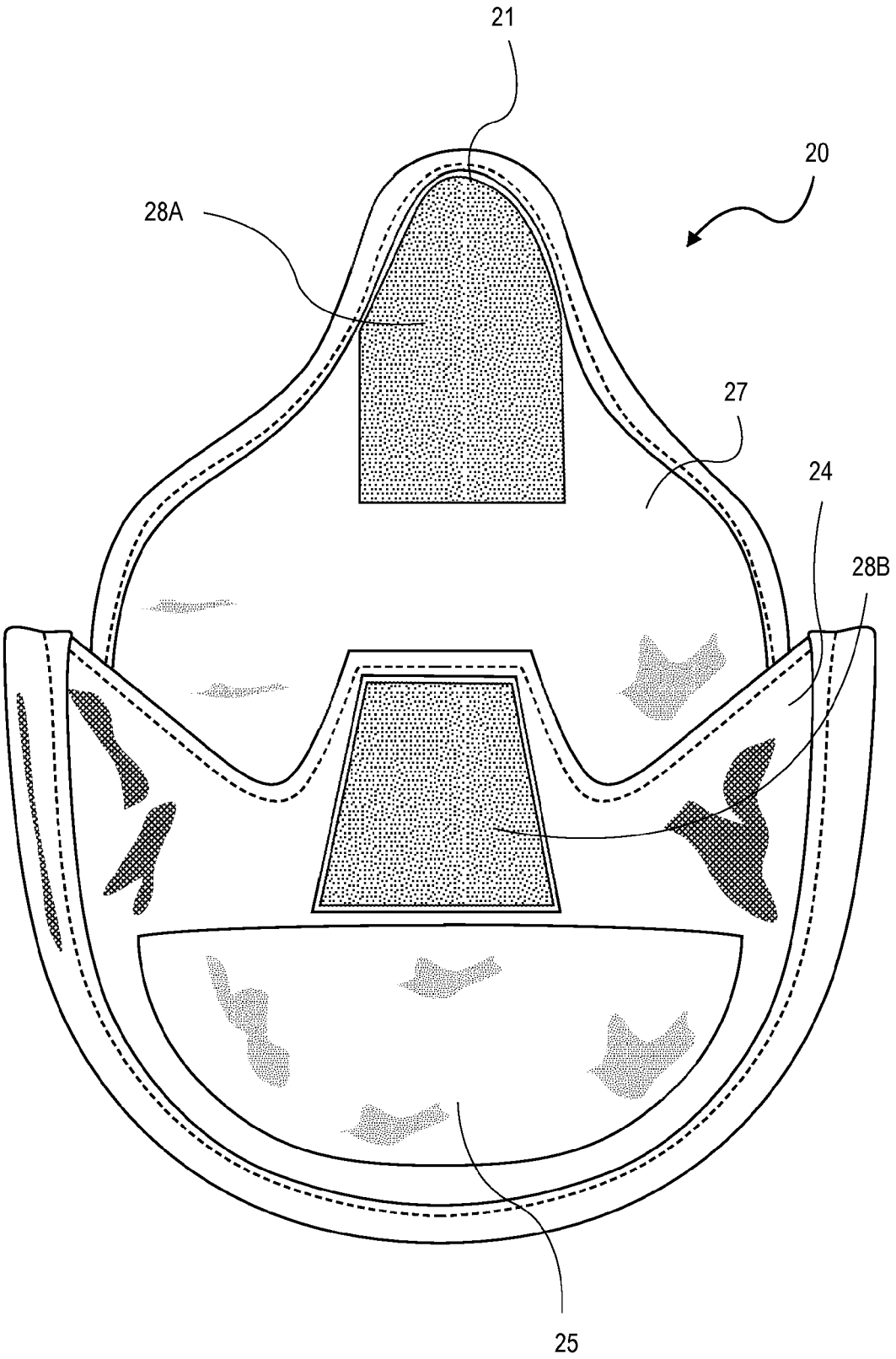
FIG. 4 is a top plan view of the head cover of FIG. 1 with the front flap extended open.
Figure 5:
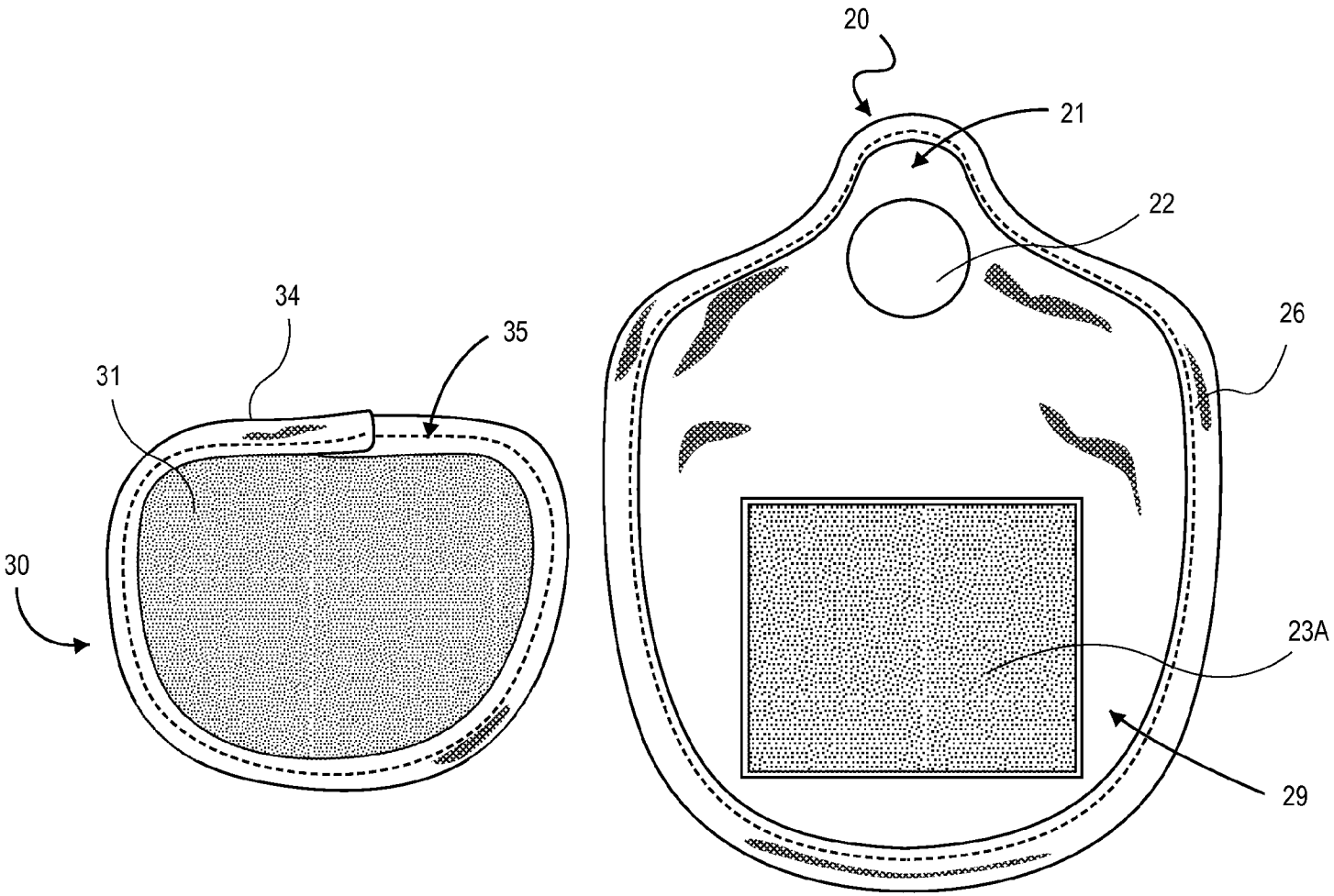
FIG. 5 is a bottom plan view of the head cover of FIG. 1 with the cleaning pad removed and in side-by-side relation.

FIG. 1 is a front perspective view of a golf putter head cover installed on a standard sized mallet-style putter, in accordance with an example embodiment; FIG. 2 is a top plan view of the head cover of FIG. 1; FIG. 3 is a bottom plan view of the head cover of FIG. 1 with the cleaning pad removed; FIG. 4 is a top plan view of the head cover of FIG. 1 with the front flap extended open; and FIG. 5 is a bottom plan view of the head cover of FIG. 1 with the cleaning pad removed and in side-by-side relation.

Referring to FIG. 1-5, there is shown a golf putter 10 composed of a shaft 12 terminating at a putter head (shown generally by arrow 15). The putter head 15 is shown enclosed within a golf putter head cover 20, hereafter "head cover 20". Head cover 20 includes an articulating or foldable front flap 21 that wraps around the base of shaft 12 so as to protect the face of the putter head 15 when not in use on the putting green. FIG. 4 shows in particular how the putter head 15 has access into the head cover 20.

The example head cover 20 offers protection to the putter head 15 and provides additional functionality not present in conventional putter head covers. In one example, the head cover 20 includes a generally large area on an underside surface 29 of the head cover 20, the bottom surface including a removable cleaning pad 30 thereon, that allows the golfer to clean their golf ball and/or club or club face.

The head cover 20 provided further functionality than a surface for cleaning a golf ball or club. The head cover 20 also includes means for securing a golf accessory having a ferrous component therein or formed of a ferrous material. An example of such an accessory may be a metal divot repair tool ("divot tool") and/or a metal ball marker for example. Each are attractable to one or more magnetic elements within the head cover 20 so as to be retained on a storage surface 25 by magnetic attraction when no other forces are placed on the accessory.

The front flap 21 may optionally include a rubberized disk 22 for company logo placement and the like, for example. The cover 20 comprises a body 24 that is formed of an outer nylon shell. The outer circumference of the shell 24 includes stitching 26 to secure the interior materials thereto, as best shown in FIG. 4.

FIG. 2 illustrates a storage surface 25 in more detail. The storage surface 25 stretches substantially across the lower top portion of head cover 20. Referring to FIGS. 2 and 4, the storage surface may be formed of a tri-layer construction. The outer layer representing the visible storage surface 25 is formed of neoprene. The neoprene material is designed to receive one or more golf accessories having either a ferrous component therein or constructed of a ferrous material (such as a divot repair tool, ball marker, metal tee, etc.). Directly beneath the neoprene layer is a middle layer (not shown) of generally flat or planar magnetic elements. The bottom layer 27 represents the interior surface of head cover 20 that received the putter head 12 therein. This is an inner liner of a felt or fleece material. The front flap 21 includes a Velcro closure 28*a* that mates with a corresponding Velcro patch 28*b* on the body 24, just above the storage surface 25.

Referring to FIGS. 3 and 5, the rear surface 29 includes a generally rectangular Velcro strip 23*a* thereon. Velcro strip 23*a* mates with a corresponding Velcro patch that is adhered by heat seal onto the back of cleaning pad 30 (shown generally by arrow 23*b* in FIG. 5) to removably affix the cleaning pad 30 to head cover 20. The head cover 20 may thus be removably attached to the putter head 15. The use of Velcro permits a "grip and rip" function that enable the golfer to quickly remove the head cover 20 from the putter head 15.

Instead of employing Velcro, closure 28*a*, patch 28*b*, strip 23*a* and patch 23*b* may be configured as magnet articles, or in a snap and receptacle arrangement. In a further alternative, a zipper may replace Velcro for removably attaching the head cover 20 from the putter head 15, and/or cleaning pad 30 from body 24.

Figure 6:
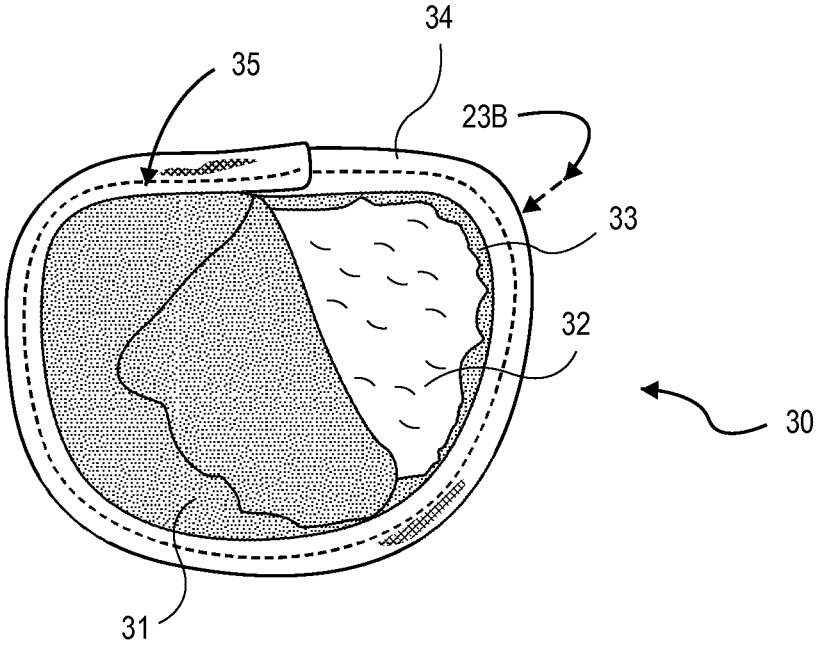
FIG. 6 is a top plan view of the cleaning plan to illustrate the tri-layer construction in more detail.

FIG. 6 is a top plan view of the cleaning plan to illustrate the tri-layer construction thereof in more detail. In an example, cleaning pad 30 may be composed of materials that facilitate water retention and include light abrasive properties to clean the golf ball.

For example, the cleaning pad 30 may include a material having a textured (rough/coarse) surface to assist in removing dirt or debris. In one example, the tri-layer material construction include a top outer layer 31 made of a microfiber material. A center layer 32 may be made of a material similar to that of the Sham Wow® cleaning cloth product on television, essentially a rayon-based material that has high moisture adsorption properties. Center layer 32 is secured with a mucilage-based adhesive between the microfiber layer 31 and a bottom polyurethane layer 33 that is folded over at its ends so as to form a trim 34. The three layers may be bound by stitching 35 or by a heat seal, for example.

In another example, one or more of the materials of the tri-layer cleaning pad 30 may be made of a suitable cotton or terry cloth, or combination of terry cloth made with filaments of one or more of cotton, polyester, polyimide, polyurethane, and a microfiber for example. Alternatively, cleaning pad 30 may be made of a combination of one or more of Narcote™, a microfiber, a sponge-like material, chamois or other equivalent type material.

In another example, the material used for cleaning pad 30 may include anti-bacterial, anti-microbial and/or mildewicidal agents. Further, cleaning pad 30 may be formed of a multi-component material which includes a bamboo material mixed or blended with other filaments, or 100% bamboo. The bamboo material has inherent anti-bacterial and anti-microbial properties. Thus, no anti-bacterial, anti-microbial or mildewicidal agents need be added to cleaning pad 30.

Alternatively to central layer 32, a water resistant barrier sheet (not shown) may be provided between the microfiber layer 31 and polyurethane layer 33 of the cleaning pad 30. The barrier sheet prevents moisture from reaching interior surfaces of the head cover 20 and hence the putter head 15.

Any suitable impervious material may be used for the barrier sheet, such as a flexible plastic sheet material of vinyl or polyolefins such as polyurethane, polyethylene and polypropylene. In an example, a bactericidal or mildewicidal agent may be incorporated into the barrier sheet to prevent the growth of bacteria or mildew. The barrier sheet may be stitched or bonded by adhesive between the underside surface 29 of the head cover 20 and the cleaning pad 30 and as such would not be in contact with the outside environment or air.

As previously shown in FIGS. 3 and 6, the cleaning pad 30 is detachable from the head cover 20 for remote cleansing operations. In an alternative example however, cleaning pad 30 may be bound, stitched or fastened by well-known textile combining means directly to the underside surface 29 of the head cover 20.

Figure 7:
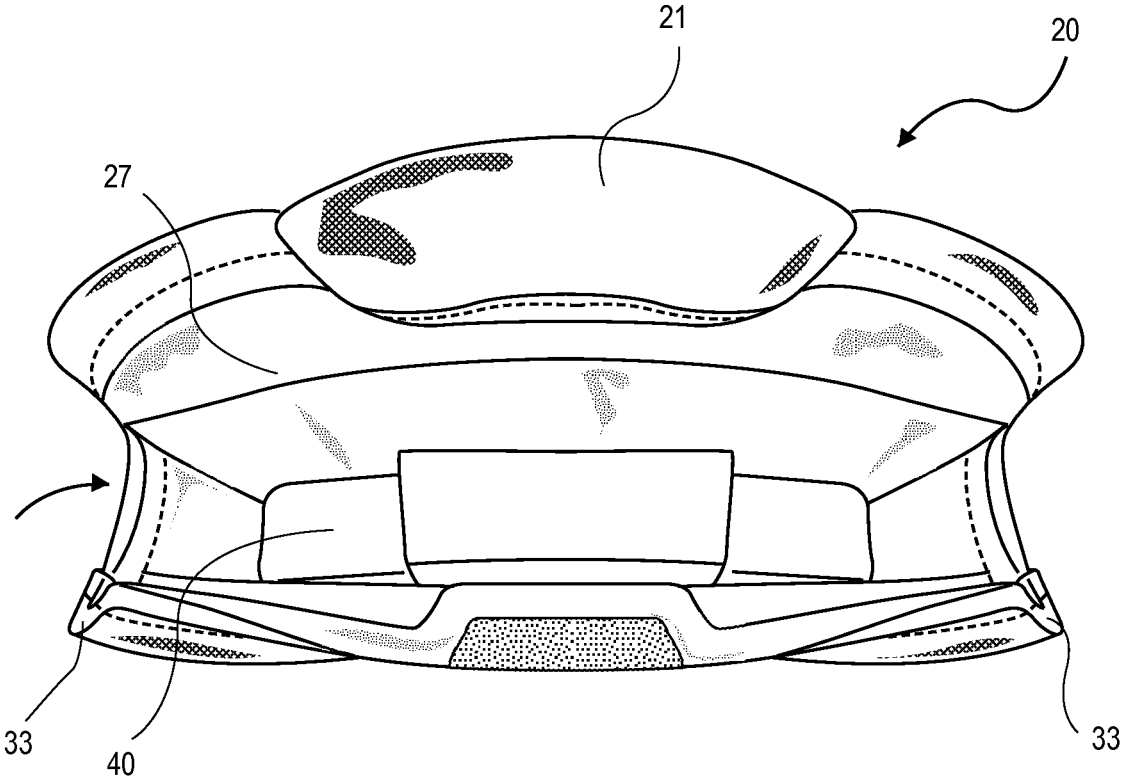
FIG. 7 is a rear view of the head cover of FIG. 1 with the front flap extended open.
Figure 8:
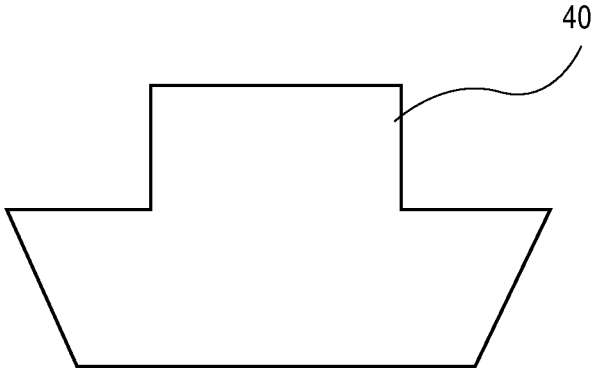
FIG. 8 is a top plan view of a form insert for the head cover of FIG. 1 to accommodate various sized putters.
Figure 9:
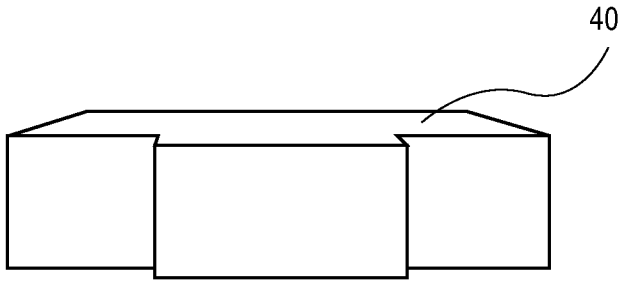
FIG. 9 is a rear view of the foam insert of FIG. 8.

FIG. 7 is a rear view of the head cover of FIG. 1 with the front flap extended open; FIG. 8 is a top plan view of a form insert for the head cover of FIG. 1 to accommodate various sized putters, and FIG. 9 is a rear view of the foam insert of FIG. 8. Referring to FIGS. 7-9, with front flap 21 open, an opening 36 into the head cover 20 can be seen, whereby a foam insert 40 is position within the bottom interior of the inner liner 27. The removable foam insert 40 is designed for use with smaller putter designs so as to hold blade-style putters and shorter/thinner mallet-style putters in place within the head cover 20. FIG. 7 also illustrates the slight turning in of the edges 33 at the opening 36 of the head cover 20. This facilitates securing of the putter head 15 therein when not in use on the putting green.

Figure 10:
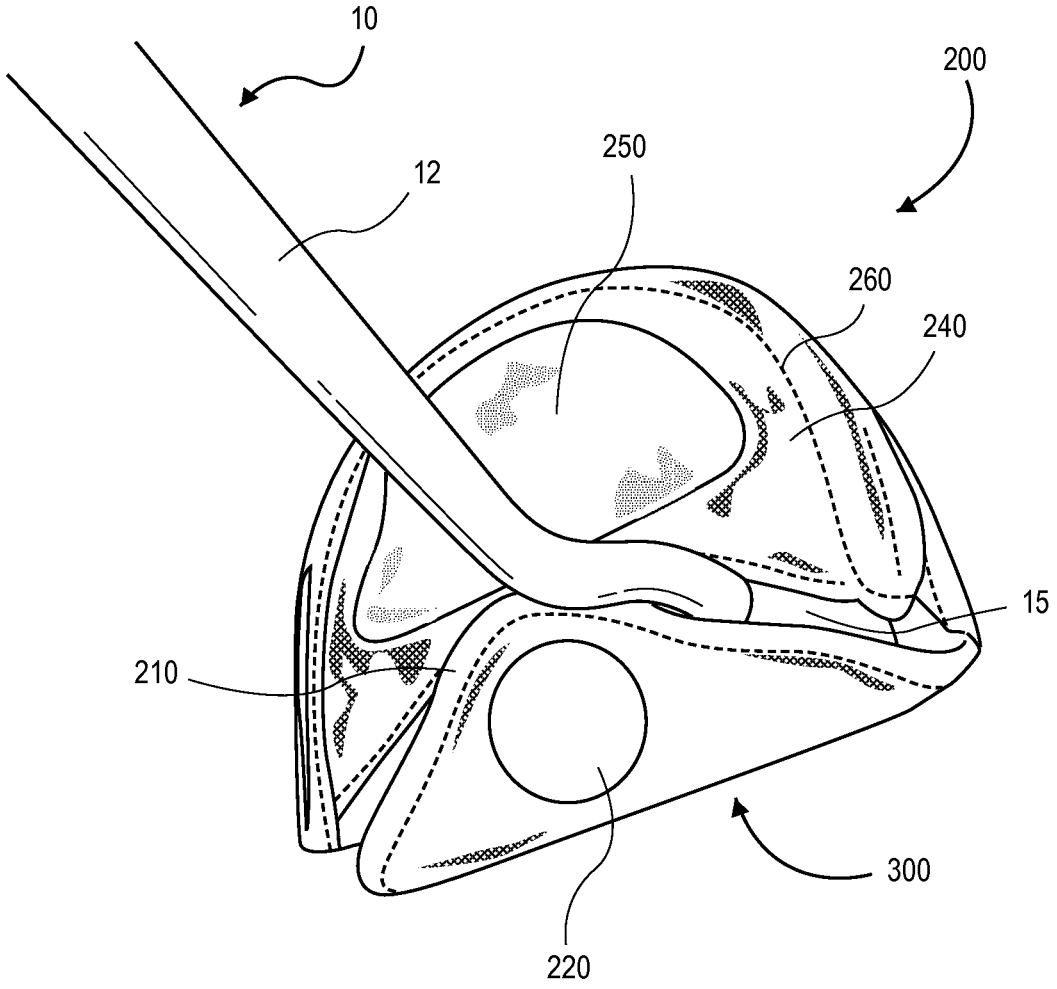
FIG. 10 is a perspective view of a golf putter head cover installed on an oversized putter in accordance with another example embodiment.
Figure 11:
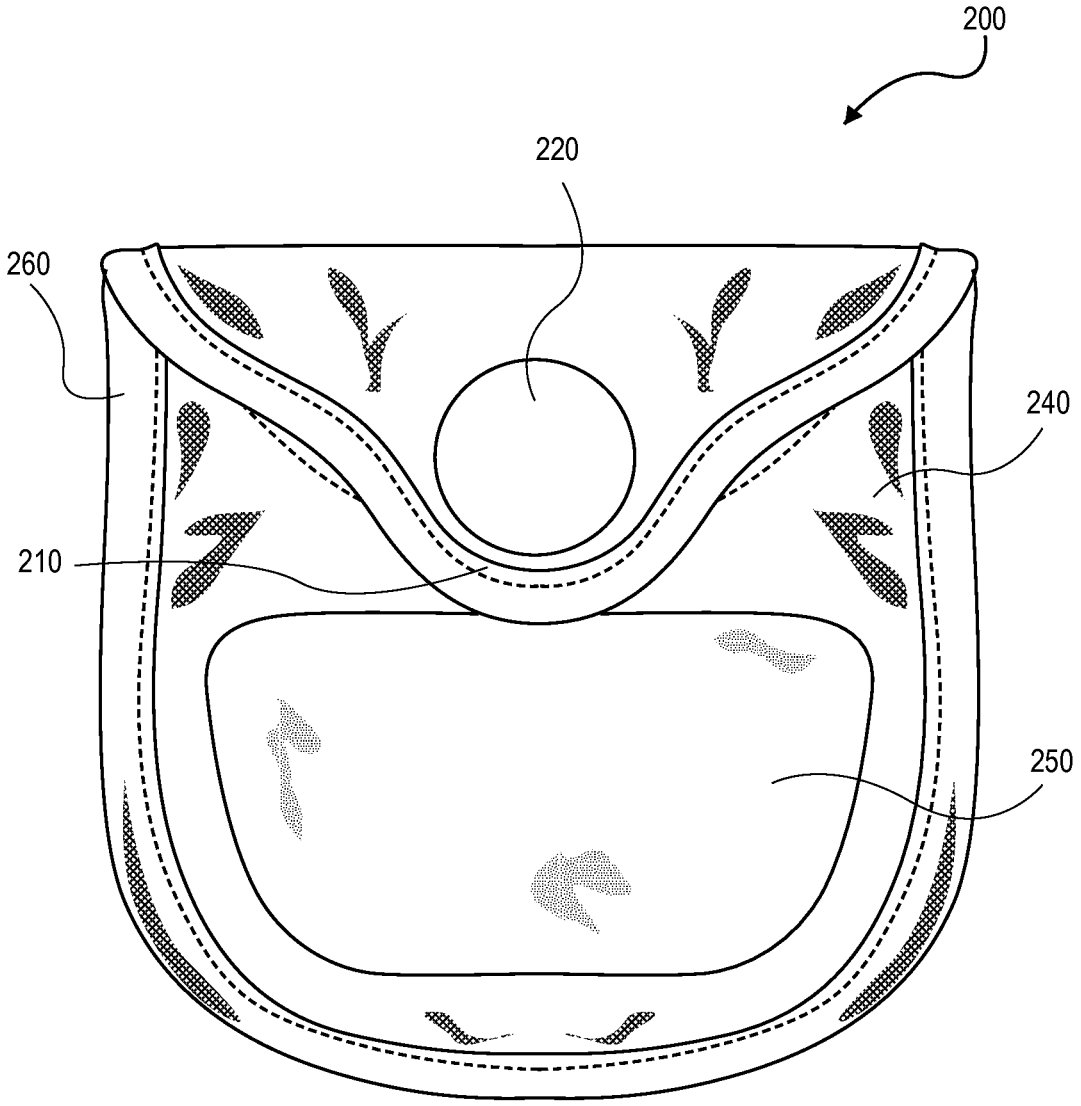
FIG. 11 is a top plan view of the head cover of FIG. 10.
Figure 12:
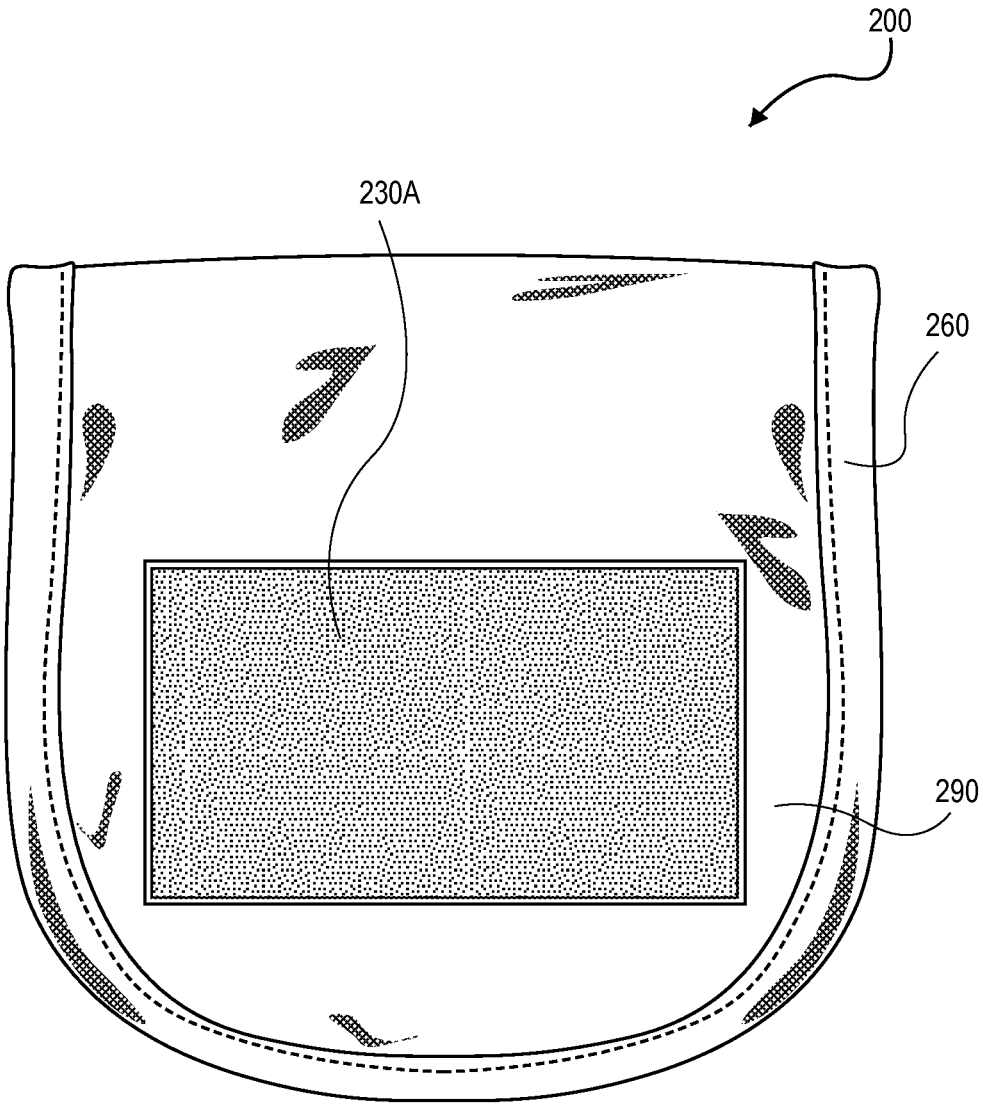
FIG. 12 is a bottom plan view of the head cover of FIG. 10 with the cleaning pad removed.

FIG. 10 is a perspective view of a golf putter head cover installed on an oversized putter in accordance with another example embodiment; FIG. 11 is a top plan view of the head cover of FIG. 10; FIG. 12 a bottom plan view with cleaning pad removed; and FIG. 13 a top plan view with the front flap extended open. As this embodiment is similar to that described with reference to FIGS. 1-5, only noted differences are discussed in detail.

Referring collectively to FIGS. 10-13, head cover 200 is designed to interact with oversized putters; otherwise its functionality is almost identical to the head cover 20 previously described, including the material components thereof. As such a detail description is omitted for purposes of brevity.

Head cover 200 includes an articulating, foldable front flap 210 that wraps around the base of shaft 12 so as to protect the face of the putter head 15. Head cover 200 includes a bottom surface 290 with removable cleaning pad 300 (shown generally by arrow 300 on bottom side of head cover 200 in FIG. 10) thereon to permit remote cleaning of a golf ball and/or club. The cleaning pad 300 is identical to cleaning pad 30 of the previous embodiment.

The head cover 200 comprises a body 240 formed of an outer nylon shell. The outer circumference of the body 240 includes stitching 260 to secure the interior materials thereto. The head cover 200 includes a storage surface 250 on a front lower surface of its body 240 for securing a golf accessory having a ferrous component therein or formed of a ferrous material, such as a metal divot repair tool and/or a metal ball marker, for example. The front flap 210 may optionally include a rubberized disk 220 for company logo placement and the like, for example.

Figure 13:
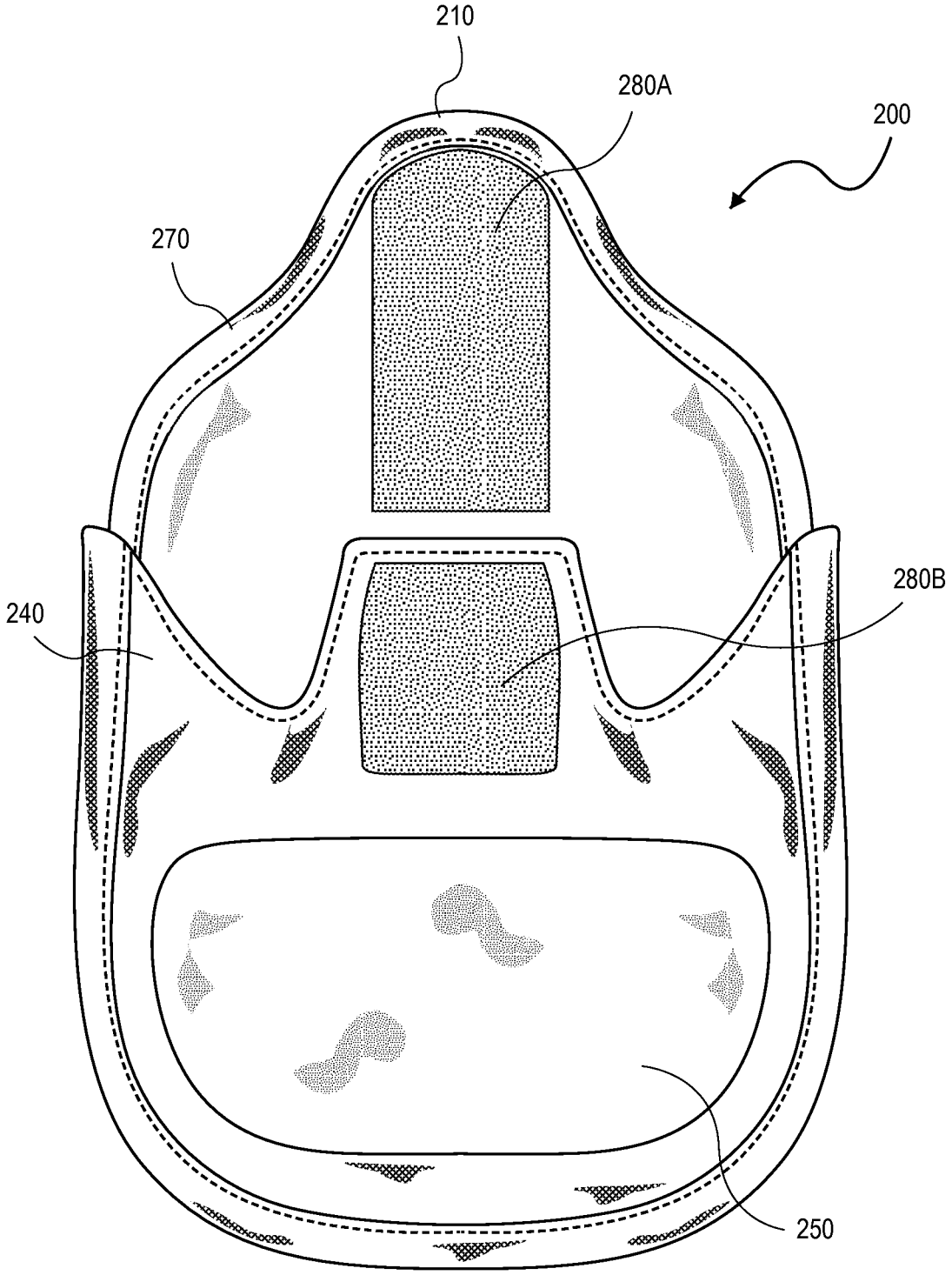
FIG. 13 is a top plan view of the head cover of FIG. 10 with the front flap extended open.

FIGS. 11 and 13 illustrate the storage surface 250 in more detail. Similar to the previous embodiment, the storage surface 250 stretches substantially across the lower top portion of head cover 200, and may be formed of a tri-layer construction. The outer layer 310 may be formed of neoprene; middle layer (not shown) of generally flat or planar magnetic elements; and the bottom layer 270 forming the inner liner of a felt or fleece material that houses the putter head 15. The front flap 210 includes a Velcro closure 280*a* that mates with a corresponding Velcro patch 280*b* on the body 240, just above the storage surface 205.

Referring to FIG. 12, the rear surface 290 includes a generally rectangular Velcro strip 230*a* thereon. Velcro strip 230*a* mates with a corresponding Velcro patch that is adhered by heat seal onto the back of cleaning pad 300 (not shown) to removably affix the cleaning pad 30 to head cover 20.

Figure 14:
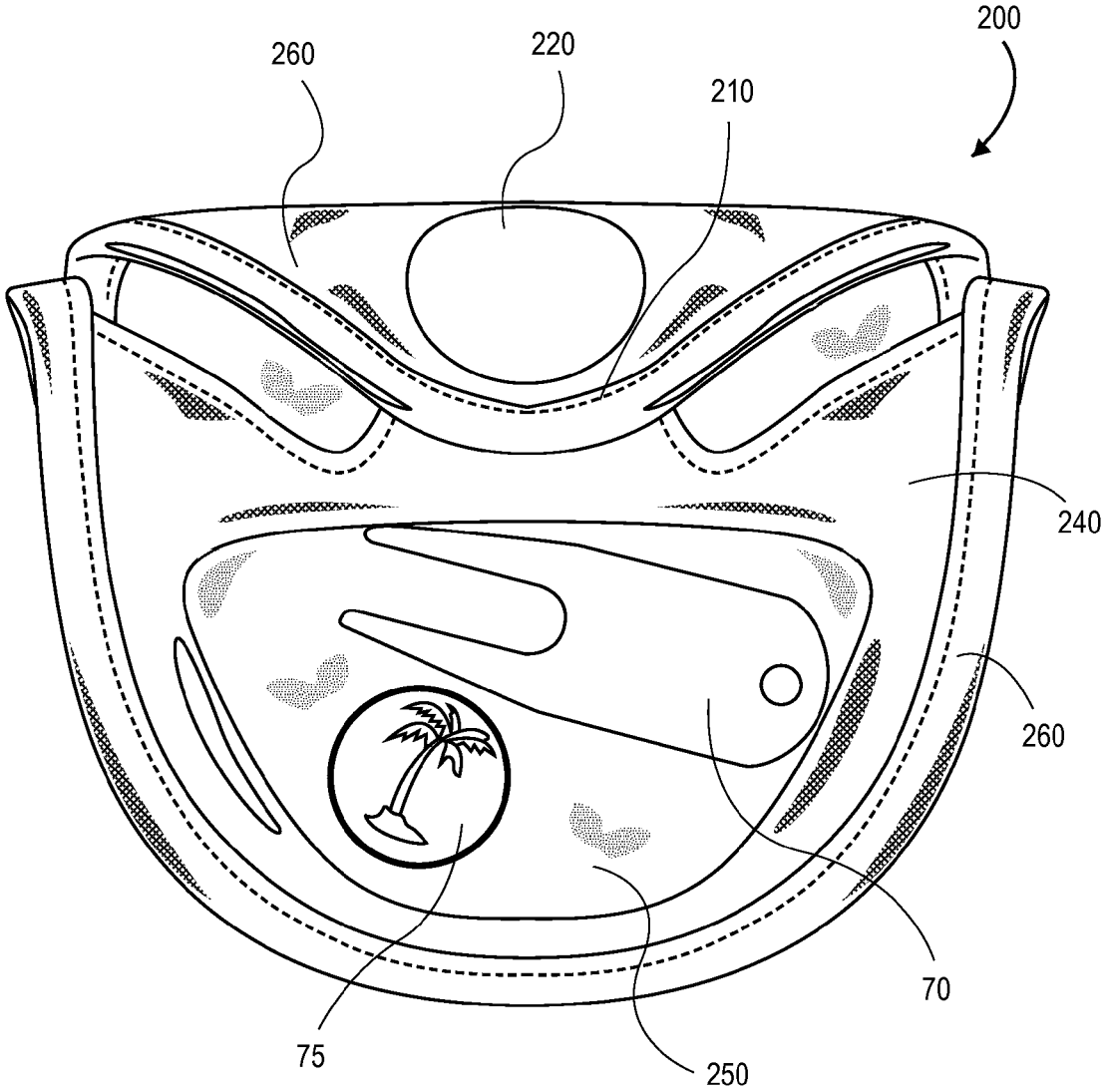
FIG. 14 is a top plan view of the head cover of FIG. 10 with accessories thereon.

FIG. 14 is a top plan view of the head cover of FIG. 10 with accessories thereon. As previously discussed, the head cover 20 is configured to retain ferrous-based golf accessories such as a divot tool and ball marker for example. As shown in FIG. 14, a divot tool 70 and a ball marker 75 are attractable to one or more magnetic elements of the head cover 200 so as to be retained on the storage surface 250 by magnetic attraction when no other forces are placed on either the divot tool 70 or ball marker 75. To use either accessory, the golfer simply overcomes the attractive magnetic force and removes one or both of divot tool 70 or ball marker 75 off of the storage surface 250 and hence away from the magnetic elements.

Although the storage surface 250 is shown configured on a lower top portion of head cover 200 and the cleaning pad 300 removably positioned on a bottom surface of head cover 200, location of the two structures could be reversed within the skill of the art.

Figure 15:
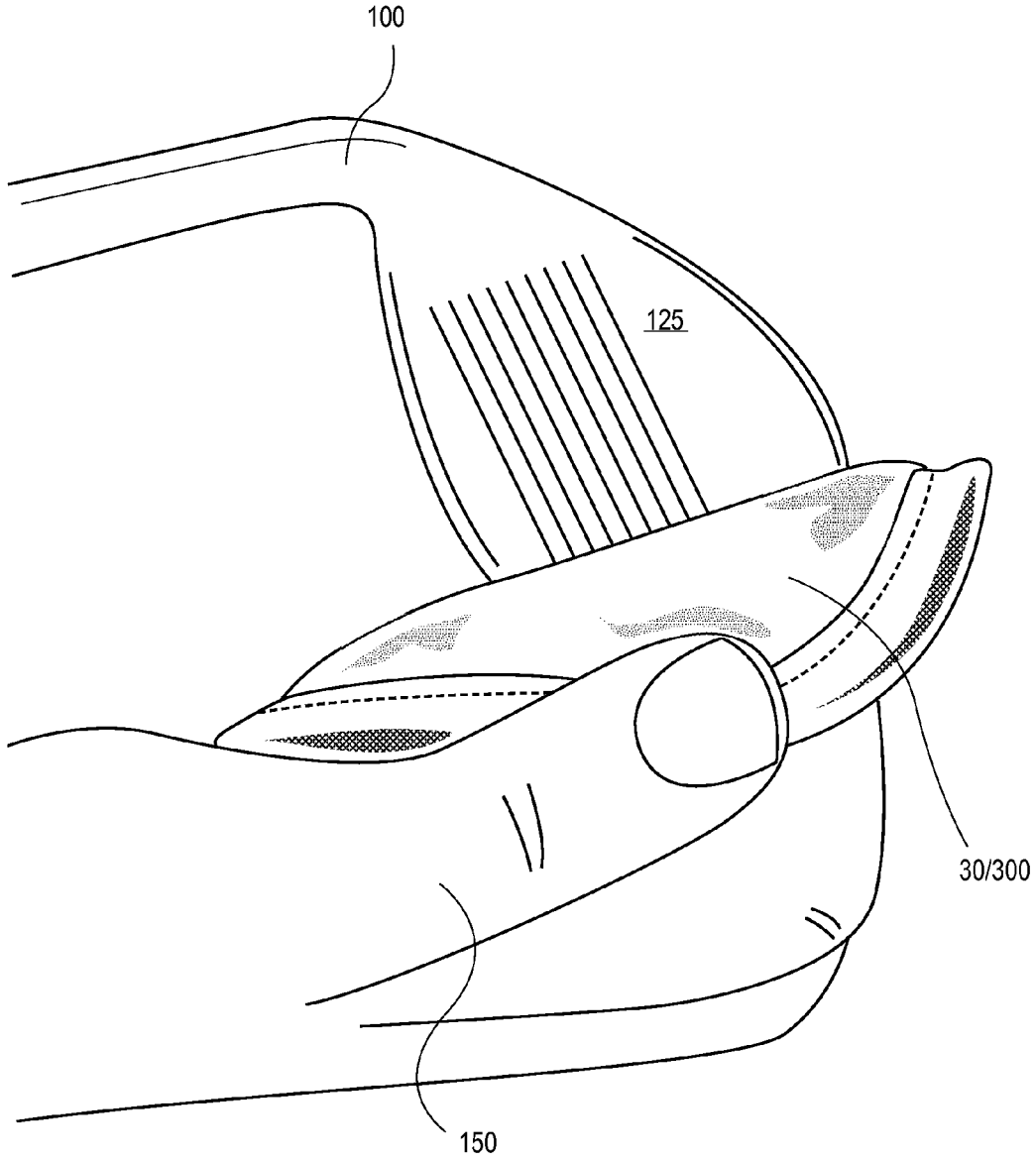
FIG. 15 illustrates use of the cleaning pad, as removed from the head cover, to remove debris from a club face, in accordance with the example embodiments.

FIG. 15 illustrates use of the cleaning pad, as removed from the head cover, to remove debris from a club face, in accordance with the example embodiments. As shown in FIG. 15, a golfer 150 has removed the cleaning pad 30/300 from the head cover 20/200. The golfer 150 may wet the cleaning pad 30/300 if desired. Grasping a club 100, the golfer 150 agitates the club face 125 with the cleaning pad 30/300 so as to loosen and/or remove dirt, grit and/or debris from grooves of the club/face 125.

Figure 16:
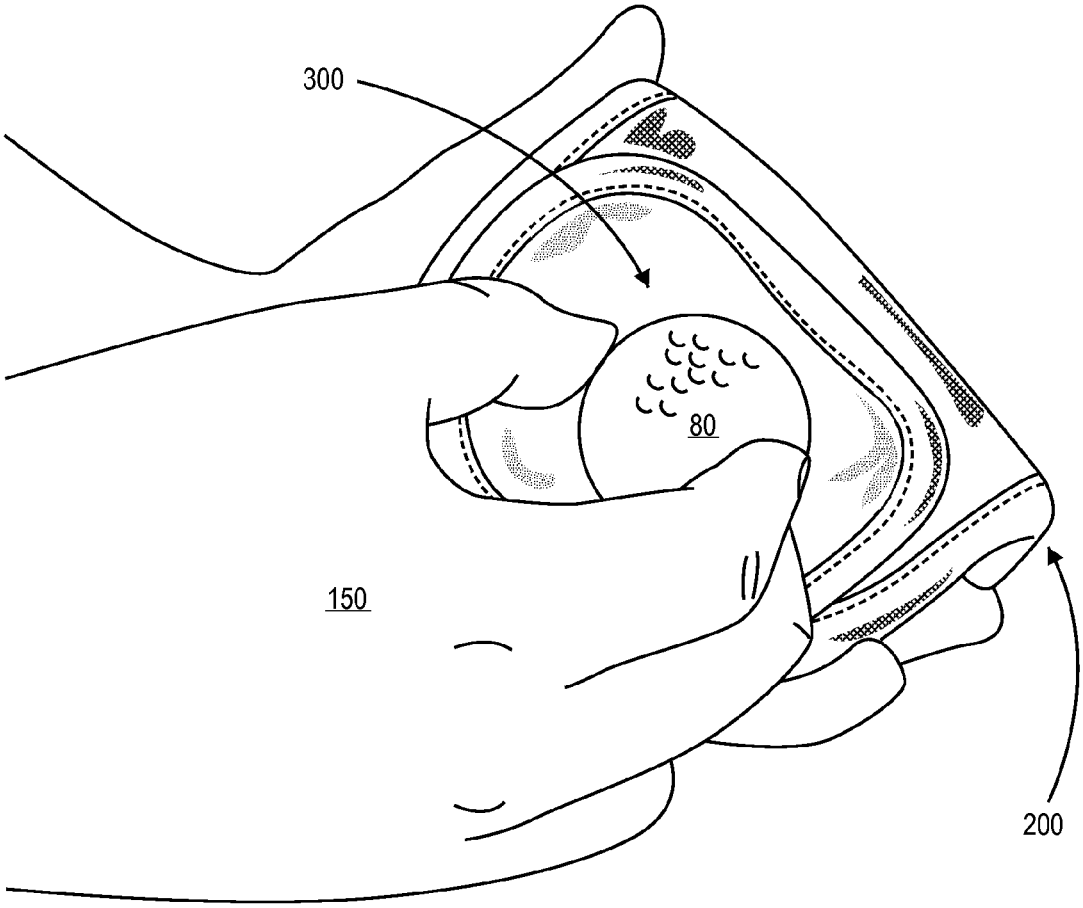
FIG. 16 illustrates use of the cleaning pad, as installed on the head cover, to clean a golf ball, in accordance with the example embodiments.

FIG. 16 illustrates use of the cleaning pad, as installed on the head cover, to clean a golf ball, in accordance with the example embodiments. In this example, the golfer 150 is using the oversized head cover 200, and has decided to leave the cleaning pad 300 on head cover 200 rather than to remove it; it being understood that he/she could remove cleaning pad 300 to clean the ball 80.

To clean the golf ball 80, the golfer 125 merely raises their putter 10 to access the head cover 200, or removes the head cover 200 from the putter head 15. The golfer 150 may wet the cleaning pad 300 if desired. The golfer then may move the ball 80 back and forth across the cleaning pad 300, or hold the ball 80 still and massage the ball 80 with the gripping action of the cleaning pad 300. Once the golf ball 80 is free of debris or grit, the golfer 150 then may dry the ball 80 and prepare for his/her putt on the green.

Accordingly, the example embodiments are directed to putter head covers used on the golf course and which provide the multiple functions of removing grass stains, dirt and other debris from a golf ball or club face, and holding on or more of a metal divot tool, metal tee, coin and ball marker thereon. Each of the example embodiments has a generally large cleaning pad adhered to the underside of the head cover using, for example, conventional attachments means. The cleaning pad is composed of a multi-layer material having water absorbing and/or anti-bacterial, anti-microbial and mildewicidal agents therein.

Additionally, the example head cover permits removable attachability of ferrous articles thereto by use of magnetic elements formed within the body thereof. Therefore, the example putter head covers may improve the ease and efficiency by which a golfer may clean their golf ball and access their divot tool and or ball marker on the putting green.

The example embodiments being thus described, it will be obvious that the same may be varied in many ways. Such variations are not to be regarded as departure from the spirit and scope of the example embodiments, and all such modifications as would be obvious to one skilled in the art are intended to be included within the following claims.

We claim:

1. A head cover for a golf club, comprising:

a body having a first surface, a second surface, and a vertical side panel extending between the first and second surfaces, a removable cleaning pad on the first surface, the cleaning pad including a microfiber scrubbing outer surface layer, central layer formed from a rayon-based material, and polyurethane inner layer, at least one golf accessory constructed of a ferrous metal removably attached to the second surface, the first and second surfaces on opposite sides of the body, and separated by the vertical side panel, and an articulating front flap configured to be attached to the second surface and extendable upward from the body so as to form an opening between the first and second surfaces for receiving a head of a golf club therein or removing the head therefrom.

2. The head cover of claim 1, wherein the second surface forms part of a lower top portion of the body and is composed of multiple layers of materials.

3. The head cover of claim 2, wherein the multiple layers further include:

an outer neoprene layer which forms an outer pad as part of the second surface of the body, a middle layer of magnetic elements, and an inner layer which forms an inner liner of the head cover for receiving the head of a golf club therein.

4. The head cover of claim 1, wherein the cleaning pad and first surface each include a Velcro patch thereon for mating engagement thereto.

5. The head cover of claim 1, wherein the front flap and second surface each include a Velcro patch thereon for mating engagement thereto to secure the club head therein.

6. The head cover of claim 1, further comprising a removable foam insert configured to be seated within the opening to accommodate club heads of various sizes.

7. The head cover of claim 1, wherein the golf club is selected from a group comprising a blade-style, mallet-style and oversized golf putter.

8. The head cover of claim 1, wherein the at least one golf accessory is selected from a group comprising a metal golf tee, a coin, a metal ball marker, and a metal divot repair tool.

9. A head cover for a golf club, comprising:

a body having an opening for receiving a head of a club therein, a cleaning pad having at least a microfiber scrubbing outer surface layer that is attached on a rear surface of the body, a removable foam insert seated within the opening to accommodate club heads of various sizes, the body including a front surface separated from the rear surface by a vertical side panel between the front and rear surfaces, a part of the front surface configured as a neoprene storage surface covering a plurality of magnetic elements for removably attaching at least one golf accessory constructed of a ferrous metal by magnetic attraction, and an articulating front flap configured to be attached to the front surface and extendable upward from the body, the front flap and front surface each including a Velcro patch thereon for mating engagement thereto to secure the club head therein.

10. The head cover of claim 9, wherein the cleaning pad and rear surface each include a Velcro patch thereon for mating engagement thereto.

11. The head cover of claim 9, wherein the golf club is selected from a group comprising a blade-style, mallet-style and oversized golf putter.

12. The head cover of claim 9, wherein the at least one golf accessory is selected from a group comprising a metal golf tee, a coin, a metal ball marker, and a metal divot repair tool.

13. A putter head cover, comprising:

a body having an opening for receiving a putter head, a removable cleaning pad attached on a rear surface of the body for cleaning one of a golf ball and a club face, and a removable foam insert seated within the opening to accommodate club heads of various sizes, the body including a front surface separated from the rear surface by a vertical side panel between the front and rear surfaces, a part of the front surface covering a plurality of magnetic elements for removably attaching at least one of a metal golf tee, a coin, a metal ball marker, and a metal divot repair tool by magnetic attraction, and an articulating front flap configured to be attached to the front surface and extendable upward from the body, the front flap and front surface each including a Velcro patch thereon for mating engagement thereto to secure the putter head therein.

14. The putter head cover of claim 13, wherein the cleaning pad and rear surface each include a Velcro patch thereon for mating engagement thereto.

15. A putter head cover, comprising:

a body having a first surface, a second surface on a side of the body opposite the first surface, a vertical side panel separating the first and second surfaces, and an opening for receiving a putter head therein, a removable cleaning pad on the first surface, a portion of the second surface of the body including a magnetized area, wherein at least one golf accessory constructed of a ferrous metal is configured to be removably attached to the second surface portion by magnetic attraction, and an articulating front flap configured to be attached to the second surface and extendable upward from the body, the front flap and second surface each including a Velcro patch thereon for mating engagement thereto to secure the putter head therein.

16. A head cover for a golf club, comprising:

a body having an opening for receiving a head of a club therein, a scrubbing pad removably attached to a rear surface of the body, the body having a front surface and a vertical side panel separating the front and rear surfaces, the front surface having a surface portion including neoprene material thereon covering a plurality of magnetic elements for removably attaching at least one golf accessory constructed of a ferrous metal by magnetic attraction, and an articulating front flap configured to be attached to the front surface and extendable upward from the body, the front flap and front surface each including a Velcro patch thereon for mating engagement thereto to secure the club head therein.

* * * * *